United States Patent [19]

Esser

[11] 3,956,808

[45] May 18, 1976

[54] METHOD OF MANUFACTURING A TUBE ASSEMBLY FOR ELECTRIC LAMPS

[75] Inventor: Leonhard Esser, Aachen-Brand, Germany

[73] Assignee: U.S. Philips Corporation, New York, N.Y.

[22] Filed: Mar. 27, 1974

[21] Appl. No.: 455,498

[30] Foreign Application Priority Data

Mar. 31, 1973 Germany ..... 2316255

[52] U.S. Cl. ..... 29/25.13; 65/59 B

[51] Int. Cl.[2] ..... H01J 9/18

[58] Field of Search..... 29/25.13, 25.14, 25.15, 29/25.16, 203 R; 65/138, 139, 140, 42, 36, 59 R, 59 A, 59 B; 140/71.5, 71.6

[56] References Cited

UNITED STATES PATENTS

| | | | |
|---|---|---|---|
| 1,472,456 | 10/1923 | Boardman | 65/139 |
| 2,267,598 | 12/1941 | Thomas | 65/138 |
| 2,530,168 | 11/1950 | Knochel et al. | 65/138 |
| 2,535,582 | 12/1950 | Knochel et al. | 65/42 |
| 3,554,241 | 1/1971 | Engel et al. | 65/139 |
| 3,689,981 | 9/1972 | LaValle | 29/203 R |

*Primary Examiner*—Roy Lake
*Assistant Examiner*—James W. Davie
*Attorney, Agent, or Firm*—Frank R. Trifari

[57] ABSTRACT

In a method of manufacturing a tube assembly for electric lamps in which a central supporting wire is supplied for the helical filament wire, according to the invention the supply of the supporting wire takes place via the exhaust tube.

3 Claims, 2 Drawing Figures

METHOD OF MANUFACTURING A TUBE ASSEMBLY FOR ELECTRIC LAMPS

The invention relates to a method of manufacturing a tube assembly for electric lamps, in which first the exhaust tube, several current supply wires and a central supporting wire for a helical filament wire are incorporated in a stem tube, after which the stem tube is sealed and the helical filament wire is provided.

In electric lamps, in particular incandescent lamps, it is often necessary to additionally support the helical filament which is stretched between two electrode wires by one or more supporting wires. In the known method of providing such a supporting wire, a central supporting wire is inserted on that side of the stem tube which is afterwards sealed by a pinching operation, after which during the pinching operation the exhaust tube, the current supply wires and the supporting wire are fixed in the stem tube. In the modern machines of manufacturing tube assemblies, however, there is normally no space for supplying a central supporting wire on the side of the pinch of the stem tube, so that said supporting wire is usually inserted from the side manually.

It is the object of the invention to provide a method of manufacturing a tube assembly in which the supply of a central supporting wire can be carried out without difficulties with the conventional machines.

In the method according to the invention this problem is solved in that the supporting wire is supplied via the exhaust tube. In this manner, the supporting wire is received through the stem of the stem tube in a trapping device provided below the stem tube, the free end of the supporting wire remaining in that part of the stem tube which is afterwards pinched.

The assembling of the tube assembly normally takes place vertically and the stem tube is sealed at its lower end. According to an advantageous embodiment of the method according to the invention the supporting wire is inserted into the upper aperture of the exhaust tube and lands in the stem tube by means of a free fall.

The invention also relates to a device for carrying out the above-described method. According to the invention this device is characterized in that in behalf of the insertion of the supporting wire into the exhaust tube, a movable funnel is present above the exhaust tube. The supporting wire supplied by a storage reel and clipped to the correct length drops into said funnel and is inserted into the exhaust tube by means of said funnel.

On its lower side the funnel preferably has a recess for receiving the upper end of the exhaust tube in a centering manner. In this manner the funnel is also centered relative to the exhaust tube.

The invention will now be described in greater detail with reference to an embodiment shown in the drawing.

Figure 1:
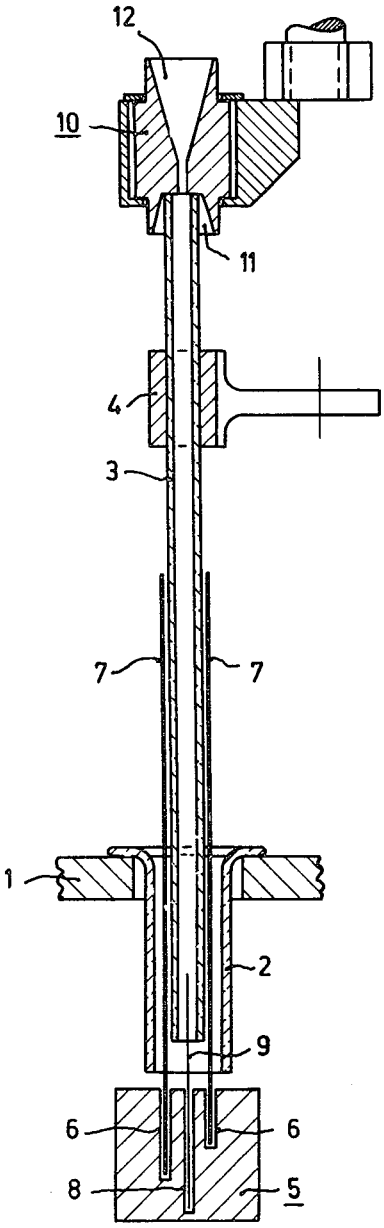
FIG. 1 is a sectional view of a device according to the invention for manufacturing a tube assembly for electric incandescent lamps.

A stem tube 2 in which an exhaust tube 3 extends which is held by tongs 4 is supported on a holder 1. Present below the stem tube 2 is a block 5 having two apertures 6 present on the side and serving to receive two current supply wires 7 and a central aperture 8 which serves to receive a central supporting wire 9.

A movably provided funnel 10 is present above the exhaust tube 3 and can both be moved in the lateral direction and be adjusted in height. Said funnel 10 has on its lower side a conical recess 11 which upon placing the funnel 10 on the upper end of the exhaust tube 3 is centered relative to said exhaust tube. A supporting wire 9 supplied by a storage reel, stretched by a device not shown and clipped to the correct length is inserted through the aperture 12 of the funnel 10 into the uppermost aperture of the exhaust tube 3, which supporting wire lands in the block 5 by means of a free fall via the stem tube 2.

Figure 2:
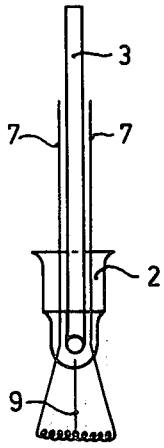
FIG. 2 shows the tube assembly at substantially natural size.

The stem tube 2 is then heated at its upper end and pinched by means of pinching blocks not shown, so that the stem tube 2, the exhaust tube 3, the current supply wires 7 and the supporting wire 9 are fixed relative to each other. The resulting tube assembly is shown in FIG. 2. Finally a helical filament wire is then stretched between the outer ends of the current supply wires 7 and supported in the center by the supporting wire 9.

I claim:

1. A method of manufacturing a tube assembly for an electric lamp which comprises: providing a generally cylindrical stem tube, positioning an exhaust tube in generally co-axial relationship to said generally cylindrical stem tube, positioning two current supply wires in axially aligned relationship to said stem tube and said exhaust tube at angularly spaced intervals intermediate said stem tube and said exhaust tube, positioning a supporting wire within one end of said exhaust tube and urging it to at least the other end of said exhaust tube and heating the stem tube and pinching the exhaust tube, stem tube, current supply wires and supporting wire to cause fusion at one common axial section of (1) said current supply wires to said stem tube and said exhaust tube, (2) said stem tube to said exhaust tube and (3) said exhaust tube to said supporting wire.

2. A method as described in claim 1 wherein said stem tube is disposed vertically and wherein said stem tube surrounds only one axial extremity of said exhaust tube and wherein said supporting wire is inserted through the end of said exhaust tube most remote from said stem tube.

3. A method as described in claim 2 where said urging step utilizes gravity.

* * * * *